United States Patent [19]

Zinnbauer

[11] Patent Number: 4,706,828

[45] Date of Patent: Nov. 17, 1987

[54] TAMPER RESISTANT CAP

[75] Inventor: Gerald Zinnbauer, Toledo, Ohio

[73] Assignee: Kardon Industries, Philadelphia, Pa.

[21] Appl. No.: 909,400

[22] Filed: Sep. 19, 1986

[51] Int. Cl.[4] ..... B65D 41/34

[52] U.S. Cl. ..... 215/246; 215/252

[58] Field of Search ..... 215/252, 253, 230, 246

[56] References Cited

U.S. PATENT DOCUMENTS

| | | | |
|---|---|---|---|
| 3,673,761 | 7/1972 | Leitz | 215/253 X |
| 3,957,169 | 5/1976 | Coursaut | 215/253 |
| 4,480,761 | 11/1984 | Aichinger | 215/252 |
| 4,573,601 | 3/1986 | Berglund | 215/252 |
| 4,591,062 | 5/1986 | Sandhaus | 215/230 |

*Primary Examiner*—Donald F. Norton

*Attorney, Agent, or Firm*—Benasutti & Murray

[57] ABSTRACT

A novel tamper-evident closure assembly for a container, such as a bottle, which can incorporate one or more tamper indicators that are severed from the closure assembly when the cap is removed. The tamper indicator can be shaped as a disk or any other distinct shape, such as in the form of a proprietary mark. Additionally, a proprietary mark, such as a trademark, can be placed on the visible surface of the tamper indicator.

8 Claims, 4 Drawing Figures

FIG. 1
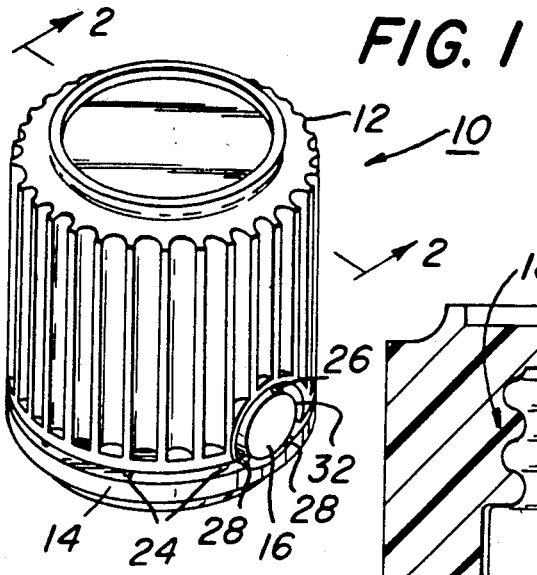
FIG. 2
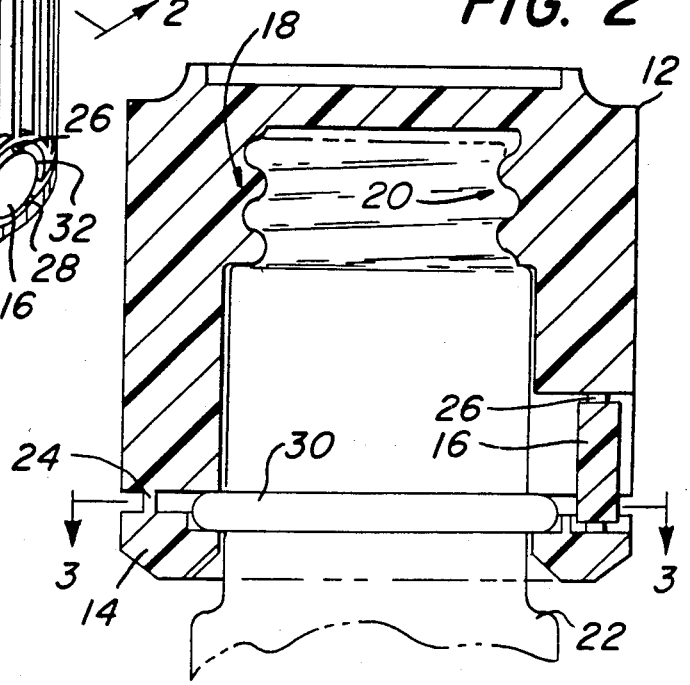
FIG. 3
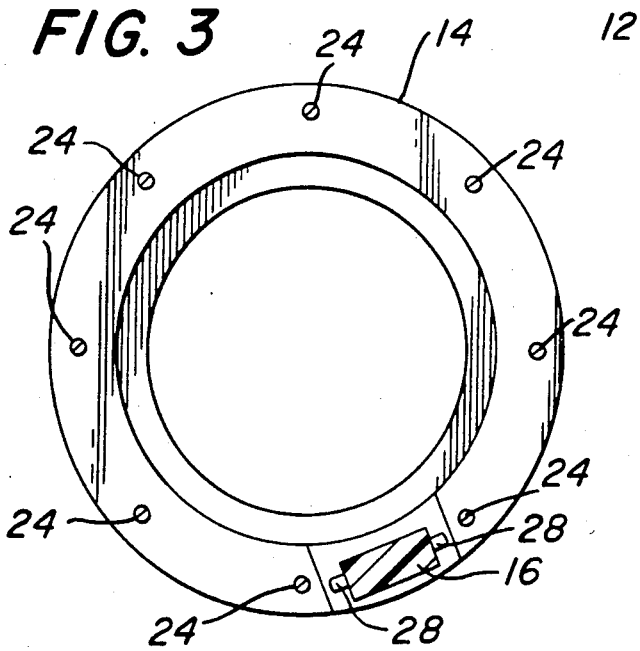
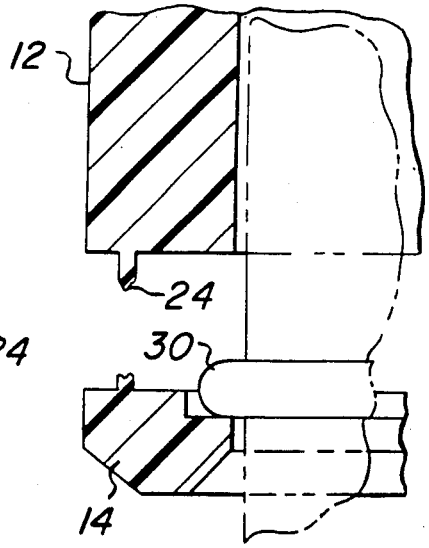
FIG. 4

TAMPER RESISTANT CAP

BACKGROUND OF THE INVENTION

This invention relates to tamper resistant caps for containers, such as bottles, which provide visual evidence of previous cap removal.

Recent instances of tampering with containers for holding food and medicine have necessitated development of a container closure that allows the consumer to visually determine if a container has been tampered with prior to use.

SUMMARY OF THE INVENTION

It is accordingly an object of the present invention to provide a novel tamper resistant cap for a container.

It is another object of the present invention to provide a tamper resistant cap which provides a visual indication of tampering.

It is still another object of the present invention to provide a tamper resistant cap which is capable of employing a visual tamper indicator in a variety of shapes.

It is yet another object of the present invention to provide a visual tamper indicator on which a proprietary mark, such as a trademark, can be placed.

It is yet another object of the present invention to provide a visual tamper indicator which can include a proprietary shape or indicator disk which separates from the cap as an indication that the seal has been broken.

The present invention utilizes a threaded plastic assembly to close a container opening. The assembly is held in place by posts that break when the cap is threaded off the container. Additionally, other posts hold a tamper indicator in place in such a manner that the posts are broken and the tamper indicator is separated from the closure assembly when the container seal is broken. An advantage of this invention is that differently shaped tamper indicators can be utilized and/or different proprietary marks can be placed on the face of the tamper indicator, and/or the indicator may be in a proprietary shape.

The invention features, in one aspect, a tamper-evident closure for a container having a cap, detachable retention apparatus, and a removable tamper indicator. The cap has internal threads capable of mating with an externally threaded container opening. The detachable retention apparatus detachably holds the cap in place over the container opening. The removal tamper indicator is integral with the cap and the detachable retention means so that the indicator will detach from the cap and/or the detachable retention apparatus when the seal is broken and/or the cap is removed from the container opening.

In preferred embodiments of the invention, the removable tamper indicator is located below the internal threads of the cap. The detachable retention apparatus includes a band capable of surrounding the outer periphery of the container opening, and a plurality of upwardly extending breakable posts that retain the band and the cap together. The removable tamper indicator is attached to the cap and the band by a plurality of breakable posts that are capable of being broken when the seal is broken and/or the cap is removed from the container. The tamper-evident closure is constructed of moldable plastic.

The invention features, in another aspect, a heat shrinkable tamper-evident closure for a container having a cap, a band, a plurality of upwardly extending breakable posts, and a disk shaped tamper indicator. The cap has internal threads located at the upper end of the cap that are capable of mating with an externally threaded container opening. The band is capable of surrounding the outer periphery of the container opening. The plurality of upwardly extending breakable posts attach the band and the cap together. The disk shaped tamper indicator, which is integral with the cap and the band, is located at the bottom end of the cap below the internal threads of the cap. The disk shaped tamper indicator also includes a breakaway post that attaches it to the cap and a plurality of breakable posts that attach it to the band so that the disk shaped tamper indicator detaches from both the cap and the band when the cap is removed from the container.

All the features and advantages of the invention will be apparent from the following detailed description of the preferred embodiments and from the claims. For a full understanding of the present invention, reference should now be made to the following description and to the accompanying drawings.

BRIEF DESCRIPTION OF THE DRAWINGS

FIG. 1 is a perspective view of the tamper-evident closure.

FIG. 2 is a cross-sectional view of the tamper-evident closure taken along lines 2—2, of FIG. 1.

FIG. 3 is a cross-sectional view of the lower portion of the tamper-evident closure taken along lines 3—3 of FIG. 2.

FIG. 4 is a partially cutaway, enlarged, cross-sectional view of the lower portion of the tamper-evident closure showing the cap and band of the closure assembly separated from each other.

DETAILED DESCRIPTION OF THE PREFERRED EMBODIMENTS

Referring to FIG. 1, there is shown a perspective view of novel tamper-evident closure apparatus 10. Closure apparatus 10 includes a cap or closure member 12, a band 14, and a tamper indicator 16. Cap 12 includes internal threads 18 which are designed to mate with corresponding external threads 20 located on container 22. Referring to FIGS. 1-3, a plurality of breakable posts 24 are shown attaching band 14 to cap 12. Additionally, tamper indicator 16 is attached to cap 12 by a single post 26 and to band 14 by two posts 28.

The operation of the invention will now be described with reference to the drawings. In the preferred embodiment, tamper-evident closure 10 is comprised of moldable plastic. This allows closure apparatus 10 to be sized so it can be easily fitted over the opening in a typical container, such as in bottle 22 shown in FIG. 2.

In the preferred embodiments, closure apparatus 10 is molded of polypropylene, polyethylene, or other suitable moldable materials which will be known to those skilled in the art. Likewise, those skilled in the art will recognized that there are a variety of ways to secure band 14 to the container. For instance, band 14 may be heat shrinkable material, however, since the apparatus 10 is molded as a unit it is preferable to use the same material for the entire apparatus. This means that care must be exercised in the heat shrink operation. Alternatively, a non-heat shrink material may be utilized with the band being heat scrubbed after location on the container. Since the material is moldable, this is a simple operation which will be known to those skilled in the art. A third alternative is to stretch the band over the lip 30 or to cause a snap fit. Both of these techniques are possible with the preferred materials of polypropylene and polyethylene.

Once closure apparatus 10 is in place over the opening in container 22, band 14 can be secured to the container to complete application of closure apparatus 10. As a result of this action, band 14 tightly surrounds the periphery of bottle 22 below lip 30 and internal cap threads 18 are mated with corresponding external bottle threads 20. Lip 30 provides a dead-lock surface which opposes the upward move of band 14 when the closure is removed. Additionally, breakable posts 24, 26 and 28 are placed in tension.

Once the bottle, closed by closure apparatus 10, is to be used, the user unthreads cap 12 by twisting it. As shown in FIG. 4, this twisting, upward motion breaks posts 24 leaving band 14 in place around the periphery of bottle 22. Additionally, the combination of the twisting upward force and movement of cap 12 results in displacing indicator 16, when it is twisted, and causing posts 26 and 28 to break, like posts 24, shown in FIG. 4. As a result, tamper indicator 16 is severed from closure apparatus 10. Therefore, a user knows if the bottle has been previously opened since tamper indicator 16 will be missing from closure apparatus 10 if bottle 22 has been opened by removing cap 12.

Further evidence of tampering will be evident from the preferred closure even if an attempt is made to replace the indicator 16. As shown in FIG. 1, the area 32 immediately surrounding indicator 16 is preferably molded to be a very smooth surface on both cap 12 and band 14. Likewise, the indicator is free standing with only the posts 26, and 28 extending into the surrounding area 32. Due to the nature of the molded plastic the posts will show visual signing of rupture, see FIG. 4, and any attempt to realign the posts and reseal the closure would be evident. The smooth surrounding surface makes it further unlikely that the posts could be reunited, such as through heat staking or ultrasonic welding, without displaying some physical sign of tampering. Since the indicator 16 is preferable proprietary, the closure will not be readily interchangeable with available closures and the manufacture can control the availability of its proprietary closures.

In altervative embodiments of the invention, one or more tamper indicators 16 can be utilized. The tamper indicator can be disk shaped, as shown in FIG. 1, or can be of any other geometric distinctive shape. To distinguish the indicator, the tamper indicator can be made in the form of a trademark or a proprietary marking can be placed on the outer surface of the tamper indicator as shown in FIG. 1.

There has thus been shown and described a novel tamper resistant cap which fulfills all the objects and advantages sought. Any changes, modifications, variations or other uses and applications of the subject invention, will become apparent to those skilled in the art upon considering the specification and the accompanying drawings which disclose the preferred embodiments. All such changes, modifications, variations and other uses and applications within the spirit and scope of the invention are deemed to be covered by the invention which is limited only by the claims which follow.

I claim:

1. A tamper-evident closure for a container, comprising:

(a) a molded plastic cap having internal threads capable of mating with an externally threaded container opening;

(b) detachable retention means for detachably holding said cap in place over said container opening; and (c) a removable tamper indicator integral with said cap and said detachable retention means located below said cap internal threads, whereby said indicator is detached from said cap and said detachable retention means when said cap is removed from said container opening.

2. The tamper-evident closure of claim 1, wherein said detachable retention means comprises a band capable of surrounding the outer periphery of said container opening, and a plurality of upwardly extending breakable posts that attach said band and said cap together.

3. The tamper-evident closure of claim 1, wherein said removable tamper indicator is attached to said cap and said band by a plurality of breakable posts, said posts capable of being broken when said cap is threaded off said container.

4. The tamper-evident closure of claim 1, wherein said closure is constructed of heat shrinkable plastic.

5. A heat shrinkable tamper-evident closure for a container, comprising:

(a) a thermoplastic cap having internal threads, located at the upper end of said cap, capable of mating with an externally threaded container opening;

(b) a band capable of surrounding the outer periphery of said container opening;

(c) a plurality of upwardly extending breakable posts that attach said band to a bottom end of said cap; and a tamper indicator integral with said cap and said band, said tamper indicator located at the bottom end of said cap below said cap internal threads and adjacent said band, and further comprising:

(i) a breakaway post attaching said tamper indicator to said cap, and (ii) a plurality of said breakaway posts attaching said tamper indicator to said band;

whereby said tamper indicator detaches from both said cap and said band when said cap is threaded off said container opening.

6. A tamper-evident closure for an open ended container, comprising:

(a) a plastic, molded cap member dimensioned to mate with and close the container opening;

(b) detachable retention means at a bottom end of said cap member for detachably holding said cap member in place about said container opening and for defining a line of detachment; and (c) a tamper indicator integral with said cap member and said detachable retention means, whereby said indicator separates from both said cap member and said detachable retention means when said cap member is displaced for removal from said container.

7. The tamper-evident closure of claim 6, wherein said tamper indicator is a geometric shape having portions overlying said line of detachment and extend on either side thereof and into said cap member and said detachable retention means.

8. The tamper-evident closure of claim 6, wherein said detachable retention means comprises a band capable of surrounding the outer periphery of said container opening, and a plurality of upwardly extending breakable posts that retain said band and said cap member together.

* * * * *